US006956320B2

(12) United States Patent
Wort et al.

(10) Patent No.: US 6,956,320 B2
(45) Date of Patent: Oct. 18, 2005

(54) FAST HEATING CATHODE

(76) Inventors: Christopher John Howard Wort, 61 Upthorpe Drive, Wantage, Oxfordshire (GB) OX12 7DG; Andrew John Whitehead, 60 Cheylesmore Drive, Frimley, Camberley, Surrey (GB) GU16 9BW; Clive Edward Hall, Heggerand 88, Cuijk (NL) 5432 CB ( * ) Notice: Subject to any disclaimer, the term of this patent is extended or adjusted under 35 U.S.C. 154(b) by 0 days.

(21) Appl. No.: 10/315,997

(22) Filed: Dec. 11, 2002

(65) Prior Publication Data

US 2004/0021408 A1 Feb. 5, 2004

(30) Foreign Application Priority Data

Dec. 11, 2001 (GB) ..... 0129658

(51) Int. Cl.[7] ..... H01J 1/14
(52) U.S. Cl. ..... 313/346 R; 313/311

(58) Field of Search ..... 313/346 R, 346 DC, 313/311, 310

(56) References Cited

U.S. PATENT DOCUMENTS 4,129,801 A * 12/1978 Soeno et al. ..... 313/346 R
5,349,264 A * 9/1994 Krings ..... 313/318.01

FOREIGN PATENT DOCUMENTS

GB 2296371 A * 6/1996 ..... H01J 1/24

* cited by examiner

*Primary Examiner*—Joseph Williams
(74) *Attorney, Agent, or Firm*—Oblon, Spivak, McClelland, Maier & Neustadt, P.C.

(57) ABSTRACT

A fast heating cathode comprises a layer of diamond, a thermionic emitting element in thermal contact with a surface of the diamond layer and means to heat the diamond layer.

38 Claims, 1 Drawing Sheet

FAST HEATING CATHODE

BACKGROUND OF THE INVENTION

This invention relates to a fast heating cathode (FHC).

A typical example of an application for a FHC is in small Travelling Wave Tubes (TWT). TWT devices require an electron gun to supply a stream of high energy electrons through an amplifying structure. The source of these electrons is normally a heated cathode, with the electron emission being a result of thermionic emission. The electrons emitted are accelerated through the amplifying section of the TWT by the application of a high voltage differential (typically 10–20 kV) between the cathode and the collector within the TWT.

Considerable effort is expended to ensure that the electron emission from the cathode surface is uniform across the emitting region and that the cathode remains at the ideal operating temperature. As a result of these requirements, the majority of cathodes used within TWT type devices require a period of time to temperature stabilise. For devices where the application may demand a more immediate use than is permitted by this stabilisation period, the device must be maintained in the "switched-on" mode.

A device which is maintained in the "switched-on" mode to avoid the lengthy stabilisation period also has disadvantages. In particular, the device needs a constant power supply and is a continual power drain. In addition, as the cathode life is finite, the total operation lifetime of the device is severely shortened, and failure may occur at an inconvenient moment.

There are two alternatives to these conventional hot cathodes. These are (a) "cold cathodes" where the work function of the material is such that electrons can move freely from the material into space at normal environmental temperatures, and (b) some form of fast heating cathode (FHC). Cold cathodes cannot at this time provide a suitable device for the applications mentioned above.

Fast heating cathodes under current development are based on conventional technologies, but using enhanced engineering designs. Typically, they use a tungsten or tantalum wire filament acting as the electron emitter, heated by a heater which is electrically isolated to avoid voltage drops along the emitter itself. Most developments are based on modifications to the method of applying the heat rapidly and uniformly, including techniques as diverse as lasers and electron beam guns.

SUMMARY OF THE INVENTION

According to the present invention, a fast heating cathode comprises a layer of diamond, a thermionic emitting element in thermal contact with a surface of the diamond layer and means to heat the diamond layer.

The thermionic emitting element may be a layer of metal or diamond or other suitable inorganic material, suitably doped.

The heating means will generally be a heater element such as an electrical resistance element. This element may be in thermal contact with a surface of the diamond layer or embedded therein.

DESCRIPTION OF EMBODIMENTS

Figure 1:
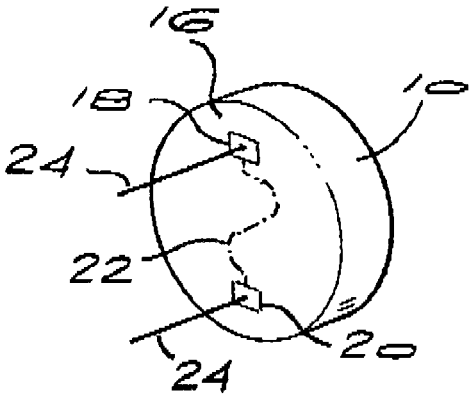
FIGS. 1 and 2 illustrate alternative views of a first embodiment of the invention.

The diamond layer acts as an electrical insulator between the heating means and the thermionic emitting element and also as a rapid heat transfer medium. This provides a rapid thermal response at the surface in thermal contact with the thermionic emitting element and also temperature uniformity over the area of the interface between the layer and the element.

The diamond layer may be single crystal or polycrystalline in nature and either natural or synthetic. Synthetic diamond includes high pressure high temperature (HPHT) diamond, and chemical vapour deposition (CVD) diamond. The surface of the diamond layer in thermal contact with the thermionic emitting element will generally be smooth, preferably polished, although surface structures may also be provided to enhance either the adhesion of this element to the diamond surface or enhance the surface emission.

The diamond layer will typically have a thickness in the range 100–2000 $\mu$m (dependent upon both the required voltage stand-off and device geometry) and a surface area of between 0.1 and 1000 square millimeters. It will generally be of a round geometry, in plan, although other geometries are equally possible. The geometry of the device need not be planar, and could be curved or otherwise shaped in the lateral directions, although the preferred embodiment is a simple geometry such as planar. The diamond layer may be mounted within a conducting holder (such as a metal tube or ring) or an electrically insulating holder (such as a ceramic).

Where the thermionic emitting element is metal, this may be applied in the form of a layer to a surface of the diamond layer by, for example, sputtering or evaporation; however any other deposition methods may also be used. Interfacial coating may be used to promote adhesion between the diamond layer and the metal element. The metal layer will be typically 0.5–50 $\mu$m thick and may cover the entire surface or just part of the surface of the layer to which it is applied.

Where the thermionic emitting material is formed by a layer of doped diamond, the doped layer can be produced by any method known in the art. The thickness of the doped layer will typically be 0.5 to 50 $\mu$m. The diamond of the doped layer can be natural or synthetic. Where the layer is synthetic, the doping may occur during synthesis or subsequently, by for example implantation. A typical dopant for this purpose is boron, although other dopants such as sulphur and phosphorus may be used; even dopants with high activation energies are suitable for these devices because of the typically high operating temperatures. The doped layer may vary in dopant and in dopant density throughout its thickness. The (undoped) diamond layer may be grown on to the doped diamond layer using it as a substrate, or the doped layer may be grown by CVD or HPHT techniques on to the (undoped) diamond layer, or the two diamond layers (doped and undoped) may be bonded together by some other means. Bonding may be achieved by a metal layer. The metal may also serve to enhance the electrical conductivity of the device or even act as the primary electrical contact to the thermionic emitting element.

The heater element may take the form of an electrical resistance element. This element may be formed on the opposite surface of the diamond layer to that of the thermionic emitting element, or within the layer preferably near the opposite surface of that of the thermionic emitting element. The methods which may be used to produce an electrical resistance element include:

1. ion implantation of a conducting resistance track into the insulating diamond. The implanted ion can be metallic in nature or boron or carbon (all of which will form an electrically conducting, resistive track in the diamond). The implanted track may be either a simple line or plane of resistance or a more complicated resistance path depending upon the device requirements. One advantage of this technique is that the heater element is "buried" within the electrically insulating diamond.
2. the deposition or other bonding of a conducting resistance layer on the surface of the diamond layer remote from the thermionic emitting element This could be a simple metallic layer or an electrically conducting, doped synthetic diamond layer such as B-doped CVD diamond. The heater can be a simple linear or planar structure or, in order to control the position or electrical characteristics of the heater, it may be patterned. A patterned heater path can be fabricated either by patterned deposition or by the subsequent patterning of the resistive layer. One advantage of this technique is that a greater range of resistance material (and patterns) can be considered to form the heater track, reducing thermal expansion mismatch and thus induced stress.
3. a laser graphitisation track may be formed in a surface of the diamond by, for example, a focused YAG laser. The track depth and width will be made to suit the required heater resistance. The track can be subsequently filled with another material either to alter the heater resistance or protect the graphitic layers from erosion. This technique is cheap and simple.

Each technique for providing a heater element has its own advantages and disadvantages, however, the operational principal is generally the same. A resistance element will heat up when a current is applied, with the heater power being proportional to the heater resistance and the square of the applied current. The required heater power depends not only upon the mass of the heated components and the temperature required, but also upon the precise cathode and heater geometry and supports, which determines amongst other things the heat loss by conduction and irradiation. An alternative method of applying energy to the heater element is by electrical induction.

Some form of temperature sensor may be applied to the FHC to ensure correct temperature of operation via a feedback circuit with a heater control circuit. This could be a conventional sensor (a thermocouple or platinum resistance thermometer) or a device formed within the insulating diamond based around a thermister principle, or a device based on the behaviour of a doped diamond structure either within the bulk diamond layer or the heater or thermionic emitter material where diamond is used for these elements.

Figure 2:
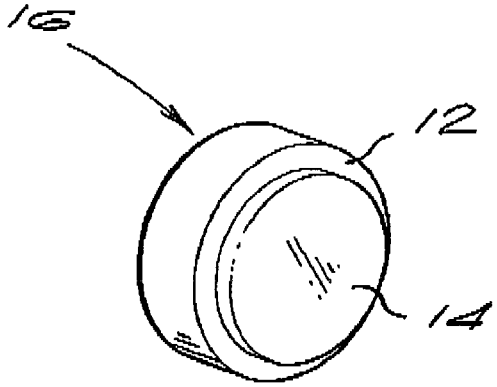

Embodiments of the invention will now be described with reference to the accompanying drawings. Referring first to FIGS. 1 and 2, a fast heating cathode comprises a layer 10 of diamond. The layer 10 has a disc shape. To the front surface 12 of the layer 10 is bonded a layer 14, also in disc form, of a thermionic emitting material. Two spaced electrical contacts 18, 20 are bonded to the opposite surface 16 of the layer 10. These contacts are in electrical contact with a heater element 22 buried in the diamond. The heater element 22 may be formed by ion implantation or by patterned boron doping. The contacts 18, 20 are also in contact with leads 24 to a suitable source of electrical power. Supply of electrical power causes the heater element 22 to heat up.

Figure 3:
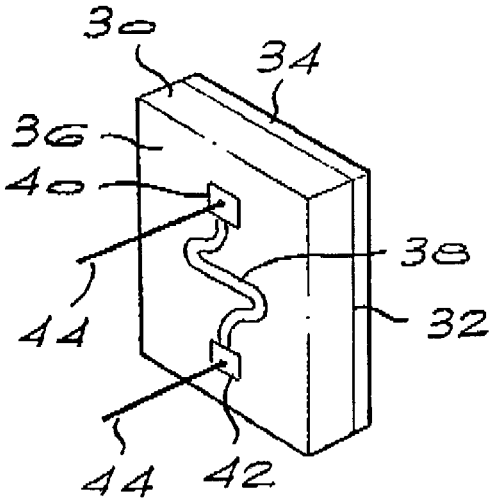
FIG. 3 illustrates a perspective view of a second embodiment of the invention.

A second embodiment of the invention is illustrated by FIG. 3. Referring to this figure, a fast heating cathode comprises a diamond layer 30 of rectangular shape. The front surface 32 of the layer 30 has bonded to it a doped diamond layer 34. The doped diamond layer 34 will generally be grown on the layer 30. The opposite surface 36 of the layer 30 has a metal heater strip 38 bonded to it. The heater strip 38 is in electrical contact with contacts 40, 42. Leads 44 supply the heater strip 38 with electrical power. Supply of electrical power causes the heater strip 38 to heat up.

Figure 4:
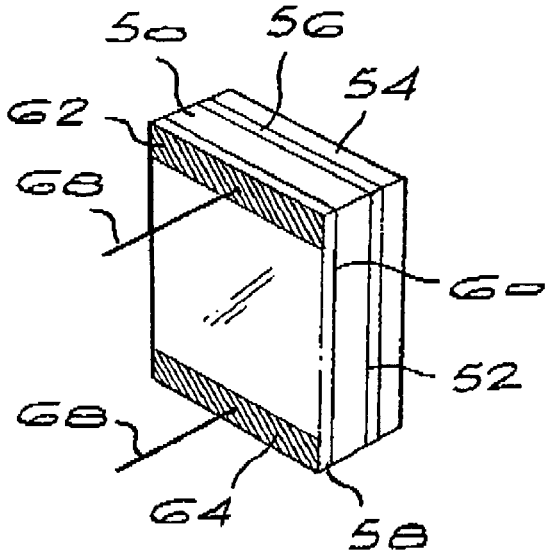
FIG. 4 illustrates a perspective view of a third embodiment of the invention.

A third embodiment of the invention is illustrated by FIG. 4. Referring to this figure, a diamond layer 50 of rectangular shape is shown. To the front surface 52 of the layer 50, there is bonded a doped diamond layer 54 through a metal bonding layer 56. An electrically conducting doped diamond layer 58 is bonded to the opposite surface 60 of the layer 50. Electrical contacts 62, 64 are bonded to the layer 58. Electrical power is supplied to the contacts 62, 64 and layer 58 through leads 68. Supply of electrical power causes the layer 58 to heat up.

The fast heating cathodes described above all operate in essentially the same manner. The thermionic emitter elements 14, 34 and 54 have a high voltage applied to them. The heater elements are caused to heat up by passing an electrical current through them. The high thermal conductivity of the diamond layers 10, 30 and 50 ensure that this heat is rapidly transferred to the thermionic emitting element causing ions to be emitted.

The main advantage of the fast heating cathodes of the invention is that the diamond layer is able rapidly to transfer the heat from the heater means to the thermionic emitting element whilst maintaining electrical isolation between the two. Other advantages are that:

1. the thermionic emitting element is uniformly heated (a consequence of the very high thermal conductivity of diamond).
2. the cathode heats very rapidly (a consequence of the low specific heat capacity combined with the high thermal conductivity in diamond) without shocking or breaking.
3. the cathode does not deform when heated rapidly (a consequence of the low thermal expansion coefficient and high Young's modulus of diamond).
4. the cathode structure is of low mass and simple in design as a single diamond component replaces several: more usual components.
5. the cathode is UHV compatible as diamond will not outgas when heated to the required temperature in a UHV environment.

The invention will be illustrated by the following examples.

EXAMPLE 1

A 15 mm diameter, planar disc of polished, polycrystalline CVD diamond (about 0.6 mm thick) was coated with a layer of boron doped CVD diamond about 200 $\mu$m thick on one surface. The boron doping concentration was chosen to be in the range of $1\times10^{18}$ to $1\times10^{19}$ atoms/cc. A heater element was then formed as a zig-zag track by using an Excimer laser to cut through the boron doped conducting layer down to the underlying electrically insulating bulk CVD diamond material in two parallel zig-zag lines. By doing this, the sample was provided with a relatively long length of resistive heater on one surface. The track width was then about 2 mm wide and had a resistance of approximately 30 ohms. The disc was mounted in vacuum with contacts to the ends of the resistance heating track and connected to a variable voltage supply. The temperature of the disc was monitored by optical pyrometry. The temperature of the disc was then adjusted to a range of temperatures in the region of 800–1000° C. by appropriately selecting the applied voltage (in the range 25–75V), and the settle time at each new temperature found to be a 10–30 seconds. In application, a thermionic emitting material is placed onto the uncoated diamond surface, thus being electrically isolated from the resistive heating element, and a feedback control loop may be used to monitor and control the operational temperature.

EXAMPLE 2

A 4 mm diameter, 1.5 mm thick single crystalline sample of diamond was subjected to high energy ion implant of carbon ions into one surface at a high dosage using well known ion lithography and masking techniques. By doing this, a conducting electrical track was formed just beneath the diamond top surface. Contacts to the two ends of the conducting track were made at opposite edges of the sample by polishing a small flat to expose the conducting layer and then metallising and attaching wire leads. The sample could thus be rapidly heated by the application of a suitable voltage (35–55V) via the two contacts to the resistive element. To turn the diamond rapid heater into a fast heating cathode, a thermionic emitting material is placed onto the untreated diamond surface, thus being electrically isolated from the embedded resistive heating element.

We claim:

1. A fast heating cathode comprising a layer of diamond, a thermionic emitting element in thermal contact with a surface of the diamond layer and a heater element formed on a surface of the diamond layer.

2. A fast heating cathode according to claim 1 wherein the thermionic emitting element is a layer of metal.

3. A fast heating cathode according to claim 1 wherein the thermionic emitting element is a layer of doped inorganic material.

4. A fast heating cathode according to claim 3 wherein the inorganic material is diamond.

5. A fast heating cathode according to claim 2 wherein the metal layer has a thickness of 0.5 to 50 $\mu$m.

6. A fast heating cathode according to claim 3 wherein the layer of doped inorganic material has a thickness of 0.5 to 50 $\mu$m.

7. A fast heating cathode according to claim 1 wherein the heater element is in thermal contact with a surface of the diamond layer opposite to that to which the thermionic emitting element is in thermal contact.

8. A fast heating cathode according to claim 1 wherein the heater element is embedded in the diamond layer.

9. A fast heating cathode according to claim 1 wherein the heater element is an electrical resistance element.

10. A fast heating cathode according to claim 9 wherein the electrical resistance element is a conducting metal track.

11. A fast heating cathode according to claim 9 wherein the electrical resistance element is a track of doped diamond.

12. A fast heating cathode according to claim 9 wherein the electrical resistance element is a laser graphitisation track.

13. A fast heating cathode according to claim 9 wherein the electrical resistance element is a conducting resistance track formed by ion implantation.

14. A fast heating cathode according to claim 1 wherein the diamond layer has a thickness in the range 100 to 2000 $\mu$m.

15. A fast heating cathode according to claim 1 wherein the surface area of the diamond layer is between 0.1 and 1000 square millimeters.

16. A fast heating cathode according to claim 1 wherein the surface of the diamond layer in thermal contact with the thermionic emitting element is smooth.

17. A fast heating cathode according to claim 16 wherein the smooth surface is a polished surface.

18. A method of producing a fast heating cathode comprising:

forming a thermionic emitting layer adjacent to a layer of diamond, wherein the thermionic emitting layer is in contact with the surface of the diamond layer, and forming a heater element on a surface of the diamond layer or within the diamond layer.

19. The method of claims 18, wherein the heater element is formed on a surface of the diamond layer.

20. A fast heating cathode comprising a layer of diamond, a thermionic emitting element in thermal contact with a surface of the diamond layer and a heater element formed on a surface of the diamond layer or within the diamond layer, wherein the thermionic emitting element is a layer of doped inorganic material.

21. A fast heating cathode according to claim 20 wherein the inorganic material is diamond.

22. A fast heating cathode according to claim 20 wherein the layer of doped inorganic material has a thickness of 0.5 to 50 $\mu$m.

23. A fast heating cathode according to claim 20 wherein the heater element is in thermal contact with a surface of the diamond layer opposite to that to which the thermionic emitting element is in thermal contact.

24. A fast heating cathode according to claim 20 wherein the heater element is embedded in the diamond layer.

25. A fast heating cathode according to claim 20 wherein the heater element is an electrical resistance element.

26. A fast heating cathode according to claim 25 wherein the electrical resistance element is a conducting metal track.

27. A fast heating cathode according to claim 25 wherein the electrical resistance element is a track of doped diamond.

28. A fast heating cathode according to claim 25 wherein the electrical resistance element is a laser graphitisation track.

29. A fast heating cathode according to claim 25 wherein the electrical resistance element is a conducting resistance track formed by ion implantation.

30. A fast heating cathode according to claim 20 wherein the diamond layer has a thickness in the range 100 to 2000 $\mu$m.

31. A fast heating cathode according to claim 20 wherein the surface area of the diamond layer is between 0.1 and 1000 square millimeters.

32. A fast heating cathode according to claim 20 wherein the surface of the diamond layer in thermal contact with the thermionic emitting element is smooth.

33. A fast heating cathode according to claim 32 wherein the smooth surface is a polished surface.

34. A method of producing a fast heating cathode comprising:

forming a thermionic emitting element on a layer of diamond, wherein the thermionic emitting element is a doped inorganic material in contact with the surface of the diamond layer, and forming a heater element on a surface of the diamond layer or within the diamond layer.

35. The method of claim 18, wherein the thermionic emitting layer is formed on the layer of diamond by sputtering or evaporation.

36. The method of claim 18, wherein the thermionic emitting layer is formed on the layer of diamond by ion implantation.

37. The method of claim 18, wherein the thermionic emitting layer is formed on the layer of diamond by chemical vapor deposition or a high pressure/high temperature technique.

38. The method of claim 18, wherein the thermionic emitting layer is formed on the layer of diamond by laser graphitisation.

* * * * *